US006416348B2

(12) United States Patent
Hio et al.

(10) Patent No.: US 6,416,348 B2
(45) Date of Patent: Jul. 9, 2002

(54) INSULATION-DISPLACEMENT TERMINAL FITTING

(75) Inventors: Masahide Hio; Eiji Kojima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/835,878

(22) Filed: Apr. 16, 2001

(30) Foreign Application Priority Data

Apr. 24, 2000 (JP) ..... 2000-122858

(51) Int. Cl.[7] ..... H01R 11/20
(52) U.S. Cl. ..... 439/397; 439/406
(58) Field of Search ..... 439/389–400, 439/406, 407, 842, 843, 850, 851, 852

(56) References Cited

U.S. PATENT DOCUMENTS

| | | | | | |
|---|---|---|---|---|---|
| 3,867,005 | A | * | 2/1975 | Hoppe, Jr. | 439/397 |
| 3,895,852 | A | * | 7/1975 | Wasserlein, Jr. | 439/395 |
| 4,040,702 | A | * | 8/1977 | McKe et al. | 439/397 |
| 4,153,324 | A | * | 5/1979 | Kukla | 439/397 |
| 4,427,251 | A | * | 1/1984 | Mathe et al. | 439/397 |
| 4,940,425 | A | * | 7/1990 | Hass et al. | 439/397 |
| 5,334,058 | A | * | 8/1994 | Hotea | 439/839 |
| 5,549,483 | A | * | 8/1996 | Hotea | 439/399 |
| 5,810,616 | A | * | 9/1998 | Ivey | 439/395 |
| 6,012,942 | A | * | 1/2000 | Volstorf | 439/397 |

FOREIGN PATENT DOCUMENTS

| | | |
|---|---|---|
| EP | 0 320 310 | 6/1989 |
| EP | 0 352 966 B1 | 1/1990 |
| JP | 57-10550 | 2/1982 |
| JP | 09-274941 | 10/1997 |

OTHER PUBLICATIONS

US 4,057,314, 11/1977, Mathe et al. (withdrawn)

* cited by examiner

*Primary Examiner*—Brian Sircus
*Assistant Examiner*—Son V. Nguyen
(74) *Attorney, Agent, or Firm*—Anthony J. Casella; Gerald E. Hespos

(57) ABSTRACT

An insulation-displacement terminal fitting (10) has plate-shaped blades (27) disposed before V-shaped contact portions (23) along a wire-insertion direction. The blades (27) make cuts (C) in an insulation coating (Wb) of a wire (W). The insulation coating (Wb) then is cut open by the V-shaped contact portions (23). A cut-open piece (Wc) of the insulation coating (Wb) that is caught by the contact portions (23) is not forcibly stretched. Thus, a core (Wa) is not pulled in a direction to be withdrawn from a clearance between the contact portions (23). An accommodation space (30) in which the caught cut-open piece (Wc) of the insulation coating (Wb) is accommodated is located within a height range of side walls (21). Thus, the cut-open piece (Wc) of the insulation coating (Wb) does not project above the side walls (21).

11 Claims, 7 Drawing Sheets

INSULATION-DISPLACEMENT TERMINAL FITTING

BACKGROUND OF THE INVENTION

1. Field of the Invention

The present invention relates to an insulation-displacement terminal fitting with substantially V-shaped insulation-displacement portions.

2. Description of the Related Art

A known insulation-displacement terminal fitting with V-shaped insulation-displacement portions is disclosed in Japanese Examined Patent Publication No. 57-10550. This terminal fitting has a bottom wall and side walls that extend up from the bottom wall. Portions of the side walls extending from the bottom wall are deformed inward to define insulation-displacement portions that are V-shaped when viewed from above. A contact edge is defined at the projecting end or apex of each V-shaped insulation-displacement portion, This design enables a wire to be pushed down between the insulation-displacement portions. Movement of the wire causes an insulation coating of the wire to be caught by the upper ends of the contact edges and to be cut open. The contact edges then bite into the cut sections and contact a core of the wire.

FIG. 8 shows an insulation-displacement terminal fitting that catches and cuts an insulation coating 1 with V-shaped insulation-displacement portions 2. The insulation-displacement portions 2 have contact edges 3 that are intended to contact the core 4 of the wire. However, as shown in FIG. 8, the insulation coating 1 may remain caught by the upper ends of contact edges 3 without being cut, and may be stretched and tom as the core 4 is pushed. In such a case, the stretched insulation coating will exert forces in a contracting direction, and those forces may lift the core 4 up in a direction to disengage from the insulation-displacement portions 2. As a result, contact reliability between the core 4 and the insulation-displacement portions 2 may be reduced.

Further, the upper ends of the V-shaped insulation-displacement portions 2 are located only slightly lower than side walls 5. Thus, the insulation coating 1 caught by the upper ends of the contact edges 3 of the insulation-displacement portions 2 may project above the side walls 5. The insulation coating 1 that projects above the side walls 5 may be caught by a terminal insertion opening when the insulation-displacement terminal fitting is inserted into a housing (not shown), thereby hindering an inserting operation.

In view of the above problems, it is an object of the invention to provide an insulation-displacement terminal fitting which provides for improved operability and contact reliability.

SUMMARY OF THE INVENTION

The invention is directed to an insulation-displacement terminal fitting with opposed side walls and at least one pair of insulation-displacement portions projecting into the space between the side walls. The insulation displacement portions cut and open an insulation coating of a wire that is pushed along a direction normal to the longitudinal direction of the wire into the space between the insulation-displacement portions. A core of the wire then contacts the insulation-displacement portions.

The insulation-displacement portions comprise contact portions that project inwardly from side walls of the terminal fitting. The contact portions preferably are V-shaped and preferably are aligned along the pushing direction of the wire. The apex of each V-shaped contact portion defines a contact edge that contacts the core of the wire.

At least one blade projects from each side wall at a location before the contact portions with respect to the wire pushing direction. Each blade preferably is a single plate and has a cutting edge at its projecting end. An accommodation space is defined between opposed blades and has a width larger than the space between the corresponding pair of opposed contact edges. The cutting edges of the blades are located more toward the corresponding side walls than the contact edges when viewed in the wire pushing direction.

The plate-shaped blades make cuts in the insulation coating while the wire is being pushed in. Accordingly, the insulation coating is cut open more reliably by the V-shaped contact portions after the blades make the initial cut. The core then is pushed between the contact portions. The cut-open piece of the insulation coating caught by the contact portions is separated reliably from a portion of the insulation coating surrounding the core and is not stretched forcibly. Therefore, the insulation coating does not pull the core in a direction to be withdrawn from a clearance between the contact portions, and a high contact reliability can be secured between the core and the contact portions.

The cut-open piece of the insulation coating caught by the contact portions is located in the accommodation space between the blades, and hence is within a height range of the side walls.

Slanted guide surfaces are formed at the rear ends of the contact edges with respect to the wire pushing direction and guide the core between the contact edges. Thus the core can be guided between the contact edges by the guide surfaces without getting caught by the contact portions.

Each contact portion preferably comprises a shelf before the contact edges with respect to the wire pushing direction. The shelf preferably extends substantially normal to the wire pushing direction, and catches the insulation coating to prevent an entrance of insulation coating into the clearance between the contact edges. Therefore, a contact failure resulting from the insulation coating caught between the core and the contact edges can be prevented.

The accommodation space preferably communicates with the space outwardly from the contact portion via a clearance between the cutting blades. Additionally, the accommodation space extends sufficiently along the wire pushing direction to accommodate the entire cut-open portion of the wire.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
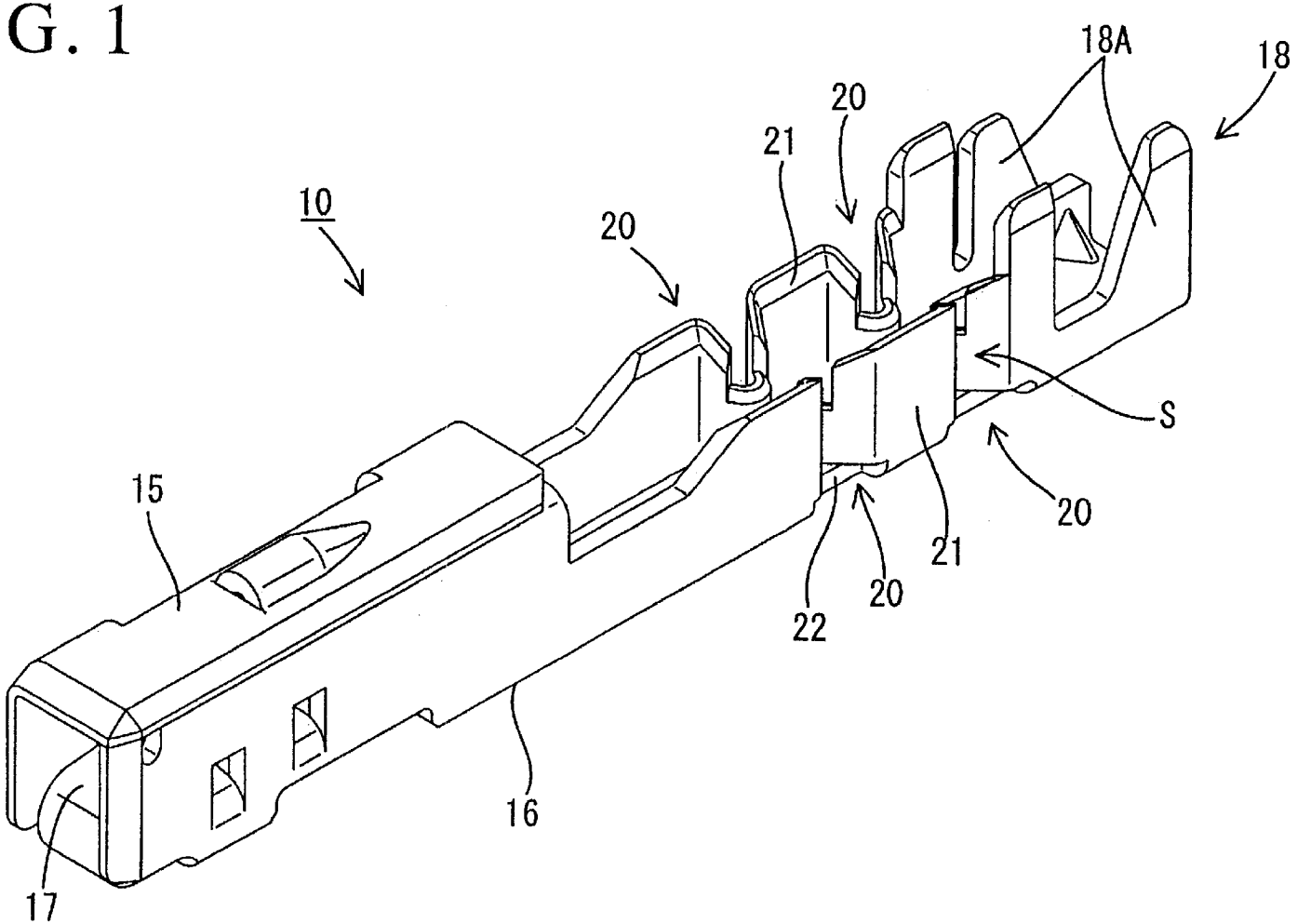
FIG. 1 is a perspective view of one preferred embodiment of the invention.
Figure 2:
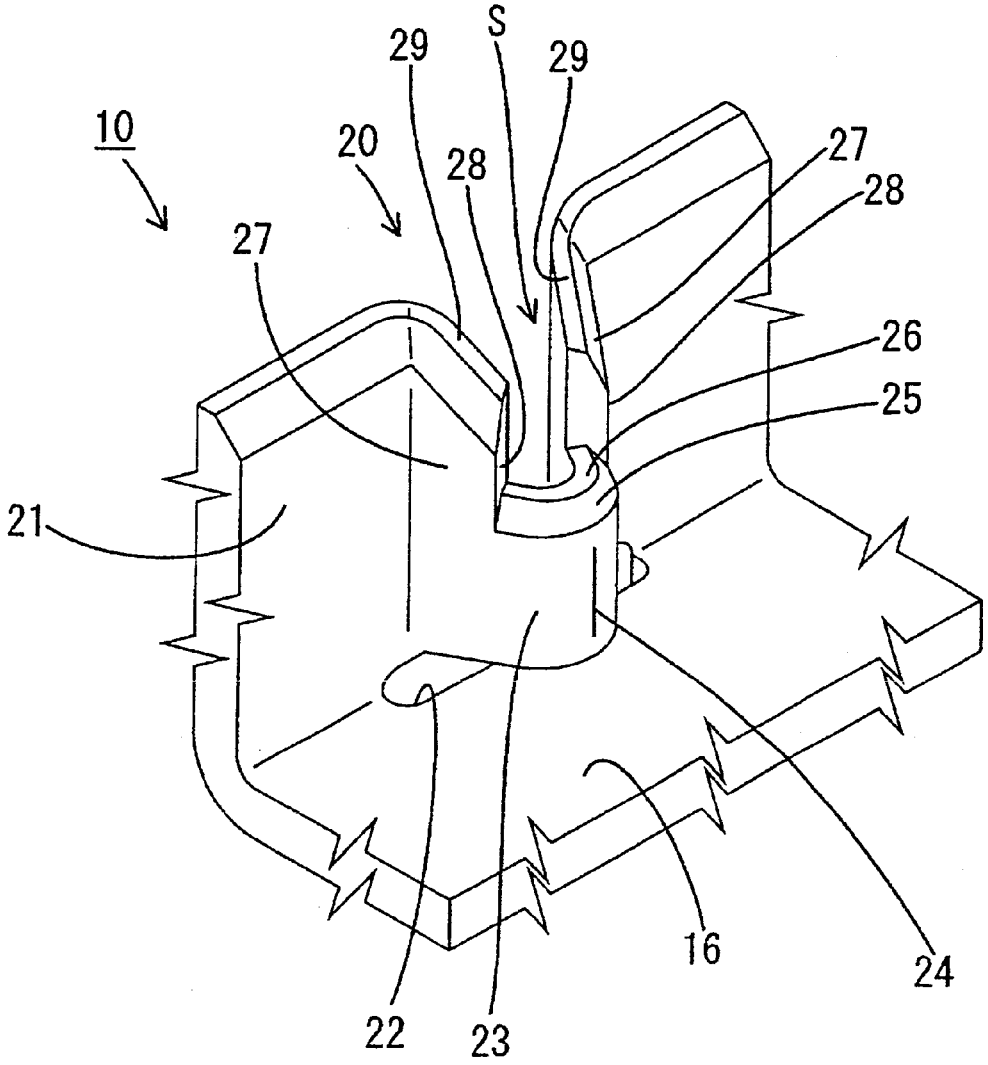
FIG. 2 is a partial perspective view showing an insulation-displacement portion.

An insulation-displacement terminal fitting according to the invention is identified by the numeral 10 in FIGS. 1–6. The insulation-displacement terminal fitting 10 is made of a metallic plate material that is stamped into a specified shape by a press to form a chained array 11 that comprises terminal materials 12 and a carrier 13, as shown in FIG. 7. The terminal materials 12 are bent, embossed and/or deformed into the insulation-displacement terminal fittings 10 of FIGS. 1–6, and are separated from the carrier strip 13 at an appropriate point in the manufacturing process.

The insulation-displacement terminal fitting 10 has opposite front and rear ends, and a hollow rectangular tubular engaging portion 15 extends rearwardly from the front end. The engaging portion 15 has a bottom wall 16, and an elastic contact piece 17 is folded rearwardly from the front end of the bottom wall 16 into the hollow tubular engaging portion 15. Thus, a tab of an unillustrated male terminal fitting that is inserted into the front of the engaging portion 15 will elastically contact the elastic contact piece 17.

An open barrel 18 is formed at the rear end of the insulation-displacement terminal fitting 10. The barrel 18 includes crimping pieces 18A that extend up from the left and right sides of a bottom wall 16. The crimping pieces 18A can be crimped or bent into connection with a wire W that is to be brought into contact with insulation-displacement portions 20, as described below. The wire W may be inserted first into the insulation-displacement portions 20 and the crimping pieces 18A then may be crimped or bent into connection with the wire W.

The insulation-displacement terminal fitting 10 includes side walls 21 that project up from the left and right sides of the bottom wall 16. The side walls 21 are aligned to the bottom wall 16 at an angle different from 0° or 180°, and preferably at substantially right angles to the bottom wall 16. Two pairs of insulation-displacement portions 20 project inwardly from the side walls 21 at locations between the engaging portion 15 and the barrel 18. The insulation-displacement portions 20 in each pair substantially face one another and are spaced slightly apart. Slits 22 are formed along folds at the boundaries between the bottom wall 16 and the side walls 21 at locations that align with the insulation-displacement portions 20. The slits 22 are formed initially, as shown in FIG. 7, and facilitate the subsequent deformation or embossment of the side walls 21 to define the insulation-displacement portions 20.

Figure 4:
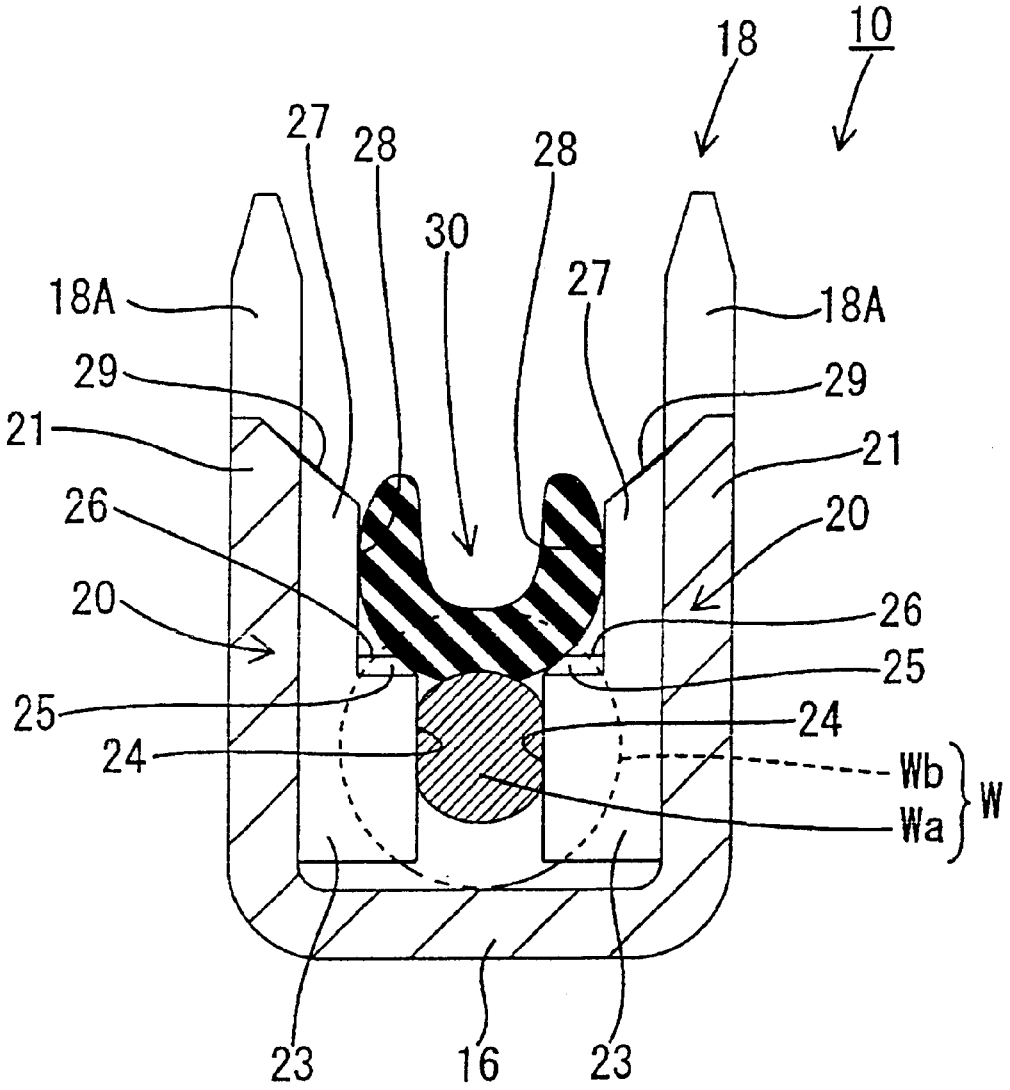
FIG. 4 is a horizontal section showing a state where the insulation displacement of the wire is completed.
Figure 5:
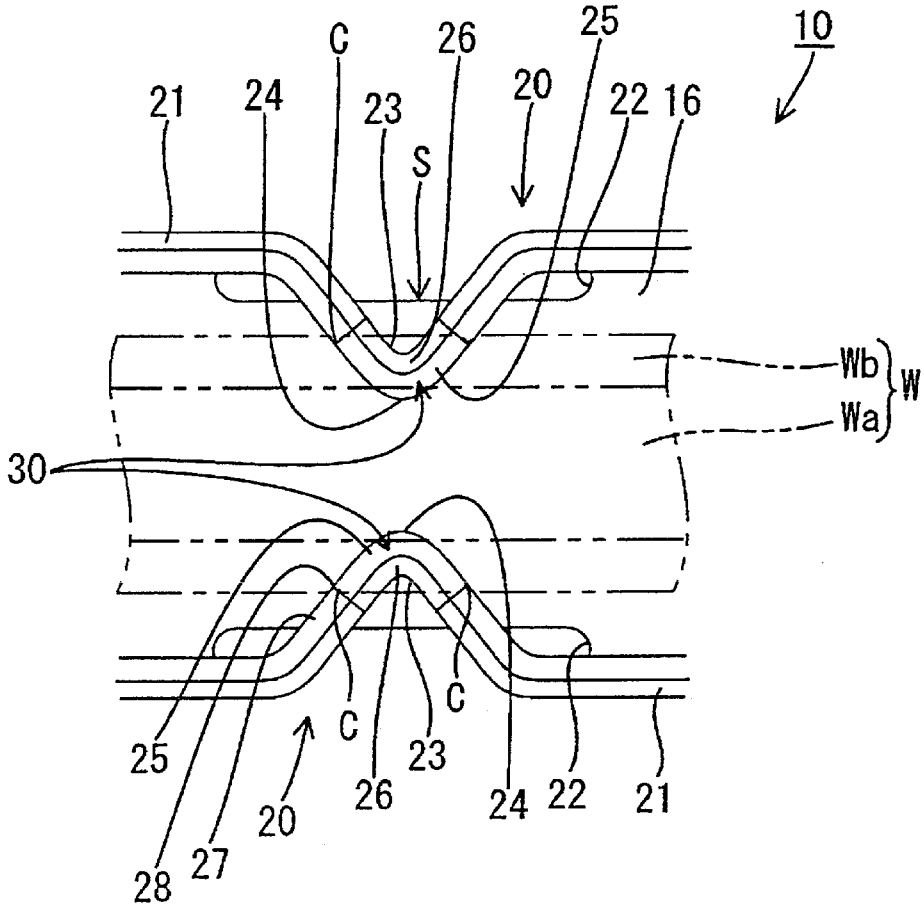
FIG. 5 is a partial plan view showing the intermediate state of the insulation displacement of the wire.
Figure 6:
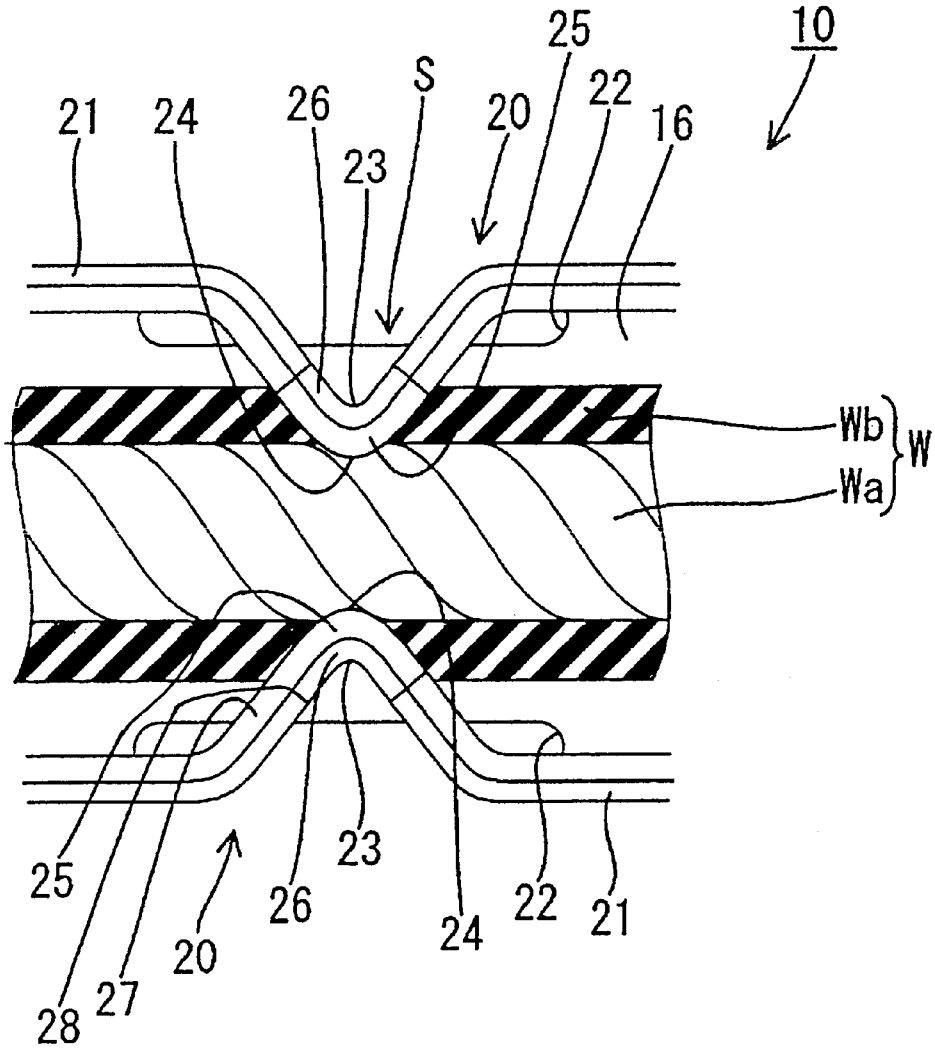
FIG. 6 is a partial plan view showing the state where the insulation displacement of the wire is completed.
Figure 7:
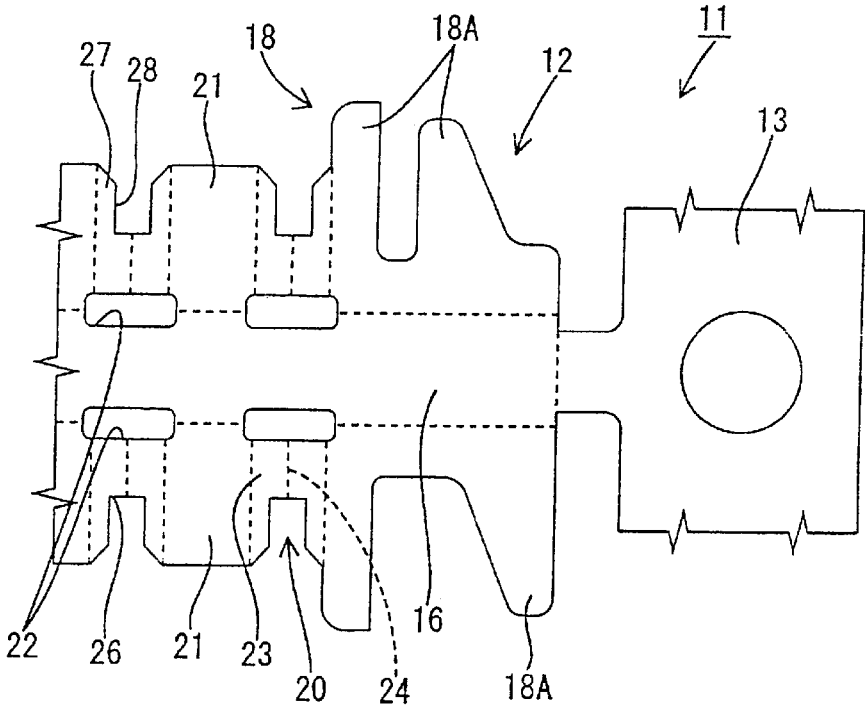
FIG. 7 is a partial development of chained terminals.
Figure 8:
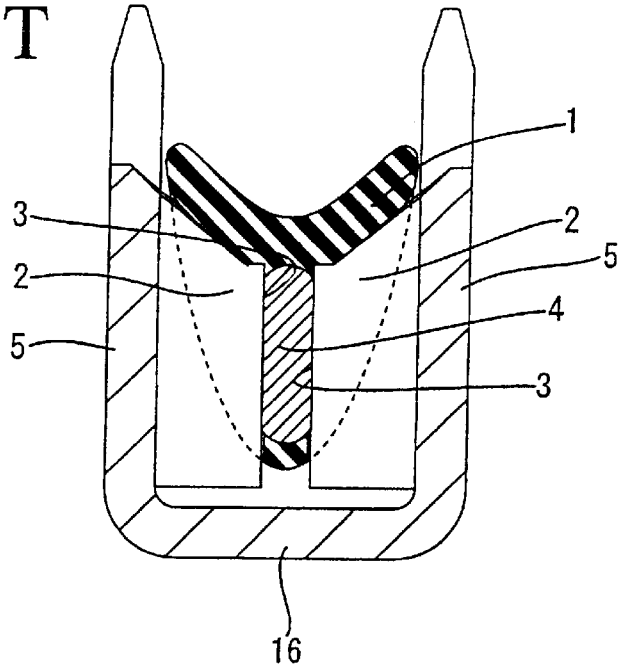
FIG. 8 PRIOR ART
FIG. 8 is a horizontal section of a prior art insulation-displacement terminal fitting.

Each insulation-displacement portion 20 has a contact portion 23 that projects inwardly from the side wall 21, and defines a substantially V-shape when viewed along the wire pushing or insertion direction shown in FIGS. 5 and 6. The apex of the V-shaped contact portion 23 defines a substantially vertically extending contact edge 24, and a core Wa of the wire W comes into contact with the contact edge 24, as shown in FIG. 4. The contact portion 23 is formed in the lower half of the side wall 21. Accordingly, the distance from the upper edge of the contact portion 23 to the bottom wall 16 is substantially half the distance from the upper edge of the side wall 21 to the bottom wall 16. However, the contact portion 23 and the contact edge 24 have heights sufficient to secure a contact with the core Wa. It should be noted that a small clearance is formed between the bottom edge of the contact portion 23 and the upper surface of the bottom wall 16 to ensure precise formation of the contact portion 23.

Figure 3:
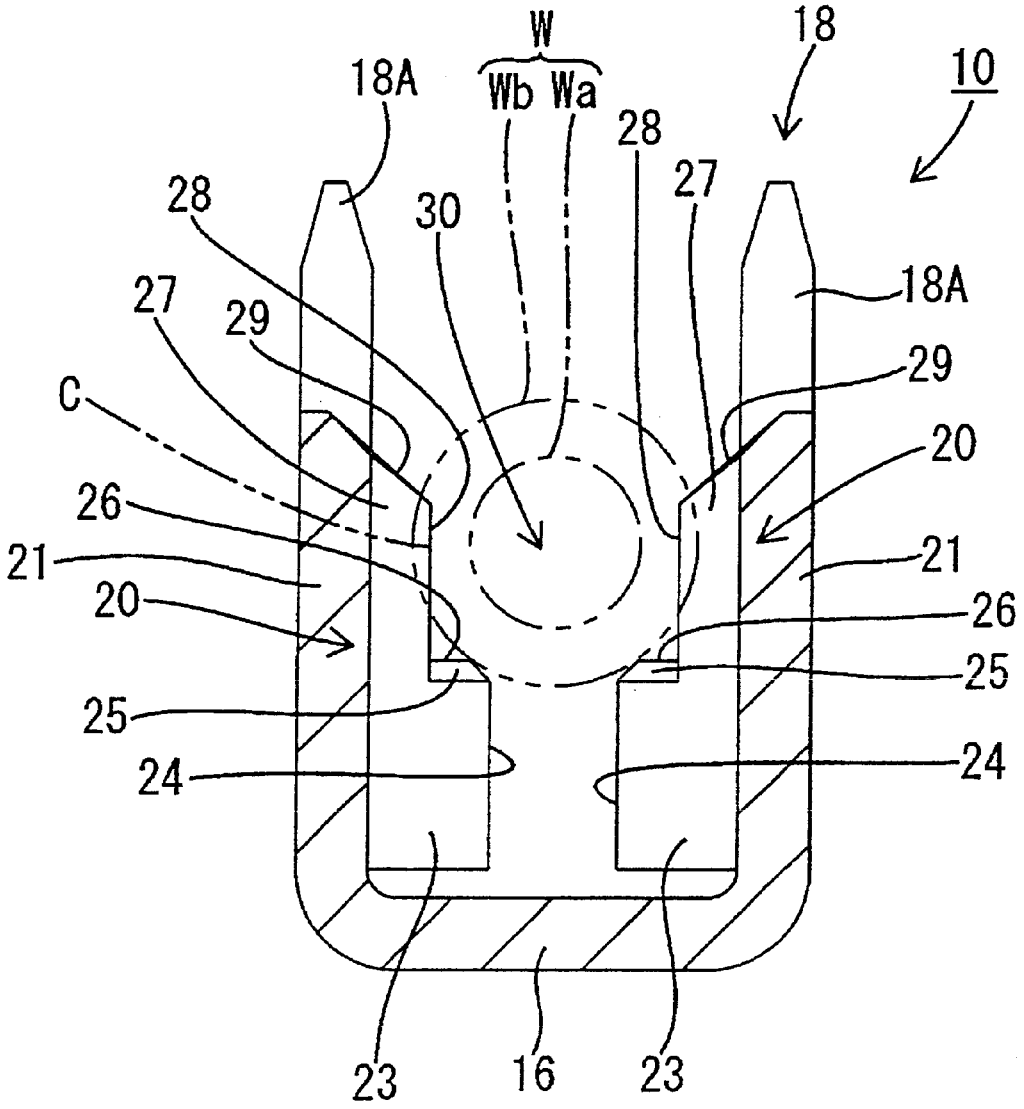
FIG. 3 is a horizontal section showing an intermediate state of insulation displacement of a wire.

The upper end of each contact edge 24 is formed with a slanted guide surface 25 which is inclined at an angle between 0° and 90°, and preferably at about 45° to the wire pushing direction when viewed along the longitudinal direction of the wire W, as shown in FIGS. 3 and 4. The inclined guide surfaces 25 guide the core Wa into the space between the opposed contact edges 24 during insulation displacement. Further, the upper edge of each contact portion 23 defines a shelf 26 that extends substantially normal to the wire pushing direction. The inner end of the shelf 26 is substantially continuous with the upper end of the corresponding guide surface 25.

Each insulation-displacement portion 20 further includes front and rear blades 27 that project from the side wall 21 at locations above the contact portion 23. Thus, each blade 27 is before the contact portion 23 in the wire pushing direction. Each blade 27 is a substantially flat plate that is substantially continuous and flush with part of the respective contact portion 23 adjacent the corresponding side wall 21. Accordingly, each blade 27 is aligned oblique to the longitudinal direction of the wire W. A cutting edge 28 extends vertically or along the wire pushing direction at the innermost part of the blade 27, and is sufficiently sharp to make a cut C in an insulation coating Wb of the wire W, as shown in FIG. 5. The cuffing edge 28 of the blade 27 is retracted toward the side wall 21 from the contact edge 24 at the leading end of the contact portion 23. Thus, the projecting distance of the cutting edge 28 from the side wall 21 is less than the projecting distance of the leading end of the contact portion 23. Furthermore, the guide surface 25 at the upper end of the contact portion 23 and the shelf 26 at the top of the contact portion 23 are disposed inwardly from the cutting edges 28 of the blades 27 of the insulation-displacement portion 20. A guiding edge 29 is defined at an upper edge of each blade 27 and is inclined down and inwardly when viewed in the longitudinal direction of the wire W.

An accommodation space 30 is between the blades 27 of the insulation-displacement portions 20 in each pair. Thus the accommodation space 30 has a width WI that extends between the opposed blades 27 and a height that extends between the shelves 26 at the upper ends of the contact portions 23 and the upper edges of the side walls 21. The width WI of the accommodation space 30 is greater than the distance between opposed contact edges 24 in each pair. Further, when viewed along the wire pushing direction, the accommodation space 30 includes substantially triangular regions defined by the V-shaped contact portions 23 and virtual planes extending in forward and backward directions between the front and rear cutting edges 28. The accommodation space 30 has a volume sufficient to accommodate a cut-open piece Wc of the insulation coating Wb that is separated from portions of the insulation coating Wb surrounding the core Wa when the insulation coating Wb is cut open by the blades 27 and the contact portions 23. Further, the clearance between the front and rear cutting edges, 28 enables the accommodation space 30 to communicate with a space S that opens outwardly beyond the concave face of the V-shaped contact portion 23.

The insulation-displacement terminal fitting 10 can cut the insulation coating Wb of the wire W and contact the core Wa of the wire W by pushing the wire W between one or more pairs of opposed insulation-displacement portions 20 in a direction substantially normal to the longitudinal direction of the wire W.

The cuts C are made in the outer surface of the insulation coating Wb by the blades 27 while the wire W is being pushed into the accommodation space 30 between the blades 27. Each blade 27 is in the form of a single plate and the wedge-shaped cutting edges 28 thereof bite in the insulation coating Wb. Thus, the cuts C can be made reliably in the insulation coating Wb (see FIG. 5).

The wire W then is pushed between the contact portions 23, and the outer surface of the insulation coating Wb is cut caught by the upper ends of the contact edges 24 at the leading ends of the V-shaped contact portions 23 and is cut open. At this time, two cuts C are made in the insulation coating Wb and extend substantially symmetrically oblique to each other. Thus, the insulation coating Wb is cut reliably from its outer surface to its inner surface along the cuts C, and a piece between the oblique cuts C becomes a cut-open piece Wc. The cut-open piece Wc is connected with a portion of the insulation coating Wb that surrounds the core Wa only at its upper side. Accordingly, the cut-open piece Wc is easily deformable into a wing-shape that extends to the left and right sides (see FIG. 4). The insulation Wb is not stretched forcibly during this deformation. As a result, there is hardly any force that tries to return the cut-open piece Wc in a closing direction toward the core Wa.

As the wire W is pushed further, the cut-open piece Wc is caught by the upper edges of the contact portions 23, and remains in the accommodation space 30. Thus, only the core Wa enters the clearance between the contact edges 24 and is connected electrically with the contact edges 24. The connection of the insulation-displacement terminal fitting 10 and the wire W is completed by crimping the open barrel 18 into connection with the wire W.

As described above, the insulation coating Wb can be cut open reliably by first making the cuts C in the insulation coating Wb. Thus, the cut-open piece Wc can remain before the contact edges 24 with respect to the wire pushing direction and is deformed without being stretched. As a result, substantially no force acts in a direction to withdraw the core Wa from the clearance between the contact edges 24. Accordingly, contact reliability between the core Wa and the contact edges 24 can be maintained.

The cut-open piece Wc of the insulation coating Wb is caught by the contact portions 23 before the contact edges 24 with respect to the wire pushing direction, and, as a result, the cut-open piece Wc is located in the accommodation space 30. As explained above, the accommodation space 30 is located between the blades 27 that project from the side walls 21, and hence is within the height range of the side walls 21. Accordingly, the cut-open piece Wc in the accommodation space 30 is within a height range of the side walls 21. Therefore, the insulation coating Wb neither projects above the side walls 21 nor gets caught by the opening edge of a terminal insertion opening when the insulation-displacement terminal fitting 10 is inserted into a housing (not shown), enabling a smooth insertion.

The guide surfaces 25 are formed at the entrance of the contact edges 24 for the core Wa and are inclined with respect to the wire pushing direction. As a result, the core Wa can be pushed smoothly and securely between the contact edges 24 without getting caught by the upper edges of the contact portions 23, and strands that form the core Wa do not become loose.

The shelves 26 are formed before the contact edges 24 with respect to the wire pushing direction and extend substantially normal to the wire pushing direction. Therefore, the cut-open piece Wc of the insulation coating Wb gets caught by the shelf portions 26 while the wire W is being pushed. Consequently, the cut-open piece Wc remains in the accommodation space 30, and does not enter the clearance between the contact edges 24. Therefore, a contact failure due to the insulation coating Wb being caught between the core Wa and the contact edges 24 can be prevented.

The present invention is not limited to the above described and illustrated embodiment. For example, following embodiments are also embraced by the technical scope of the present invention as defined in the claims. Beside the following embodiments, various changes can be made without departing the sprit of the present invention as defined in the claims.

Although the V-shaped contact portion and the blades in the form of a single plate are substantially continuous and flush with each other in the foregoing embodiment, they may be discontinuous according to the present invention. In such a case, clearances are formed between the upper edge of the contact portion and the lower edges of the blades. Alternatively, the base ends of the contact portion at the side wall may be located in different positions from the base ends of the blades when viewed in the wire pushing direction D.

Although two blades are provided in one insulation-displacement portion in the foregoing embodiment, only one blade may be provided in one insulation-displacement portion according to the present invention.

In the foregoing embodiment, an angle of the blades with respect to the side wall is substantially same as an angle of the contact portion with respect to the side wall when viewed in the wire pushing direction. However, these angles may be different according to the present invention.

Although the upper edge of the contact portion is at a right angle to the wire pushing direction in the foregoing embodiment, the angle of this upper edge to the wire pushing direction may be an angle close to the right angle. In such a case, the upper edge of the contact portion may be inclined downward toward the inner side or upward toward the inner side when viewed in the longitudinal direction of the wire being pushed in.

What is claimed is:

1. An insulation-displacement terminal fitting for a wire having a conductive core and an insulation coating around the core, the core and the insulation coating each having selected diameters, the insulation-displacement terminal fitting comprising a bottom wall, first and second opposed side walls extending from the bottom wall and defining a wire-receiving space therebetween, a first insulation-displacement portion projecting from the first side wall into the wire-receiving space, a second insulation-displacement portion projecting from the second side wall into the wire-receiving space and towards the first insulation-displacement portion, each of said insulation-displacement portions comprising a pair of wire guiding edges converging toward one another and slanted toward the bottom wall, a pair of spaced-apart cutting edges extending respectively from the wire guiding edges toward the bottom wall and being substantially normal to the bottom wall, each of said cutting edges having a bottom end, each of said insulation-displacement portions having a V-shape contact portion disposed between the cutting edges and the bottom wall, each of said V-shaped contact portions having an upwardly facing V-shaped shelf extending between the bottom ends of the spaced-apart cutting edges, such that the shelf and the respective cutting edges define a substantially U-shape, each of the V-shaped shelves having an apex spaced from the cutting edges, and a contact edge between the apex of the respective shelf and the bottom wall, the contact edges of the first and second insulation-displacement portions being spaced apart by a distance less than the diameter of the conductive core of the wire, the cutting edges of the first insulation-displacement portion being spaced from the cutting edges of the second insulation-displacement portion by a distance less than the diameter of the insulation coating, but greater than the diameter of the core.

2. The insulation-displacement terminal fitting of claim 1, wherein the wire has a longitudinal direction and the insulation-displacement portions are provided on the side walls in a direction substantially normal to the longitudinal direction of the wire.

3. The insulation-displacement terminal fitting of claim 1, wherein each said insulation displacement portion includes a contact portion, the contact portions project toward one another in a substantial V-shape and the contact edges being defined at projecting ends of the V-shape contact portions.

4. The insulation-displacement terminal fitting of claim 3, wherein the contact edges extend substantially along a wire pushing direction.

5. The insulation-displacement terminal fitting of claim 3, wherein each said shelf extends substantially normal to the contact edges for catching the insulation coating and substantially preventing an entrance of the insulation coating between the contact edges.

6. The insulation-displacement terminal of claim 5, wherein each said insulation-displacement portion further comprising a pair of blades extending upwardly from the V-shape contact portions, the guiding edges and the contact edges being formed on the blades.

7. The insulation-displacement terminal of claim 6, wherein said blades are substantially plate-shaped.

8. The insulation-displacement terminal fitting of claim 1, wherein an accommodation space is defined between the cutting edges of the first insulation-displacement portion and the cutting edges of the second insulation-displacement portion, the accommodation space communicates with an outer space behind the contact portion via a clearance between the cutting edges.

9. The insulation-displacement terminal fitting of claim 8, wherein the accommodation space has a dimension along the wire pushing direction sufficiently large that a cut-open portion of the wire can be fully accommodated therein.

10. An insulation-displacement terminal fitting, comprising a bottom wall, first and second opposed side walls extending substantially normally upward from the bottom wall, first and second insulation-displacement portions extending toward one another, respectively, from the first and second opposed side walls, each of said insulation-displacement portions comprising a V-shaped contact portion having front and rear panels converging toward one another and meeting at a contact edge defining an apex of the V-shaped contact portion, said contact edges being substantially normal to the bottom wall, each of said contact portions further comprising an upwardly facing V-shaped shelf edge extending substantially from the contact edge toward the respective side wall and terminating at front and rear shelf ends spaced from the respective side wall, each of said insulation-displacement portions further comprising front and rear blades extending upwardly from the respective front and rear shelf ends, the blades having cutting edges aligned substantially parallel to the respective contact edges, such that the cutting edges and the shelf edge of each of said insulation-displacement portions define a substantially U-shape.

11. The insulation-displacement terminal fitting of claim 10, wherein the front and rear panels of each said contact portion are substantially planar, and wherein the front and rear blades of the corresponding insulation-displacement portion are substantially coplanar with the respective front and rear panels.

* * * * *